United States Patent [19]

Moya

[11] 4,302,122

[45] Nov. 24, 1981

[54] ROTARY BRUSH INCLUDING STATIONARY GUIDE MEANS WITH SLIDABLE BEARING MEANS

[76] Inventor: Liborio A. Moya, Catamarca 1711, San Miguel de Tucuman, Argentina

[21] Appl. No.: 101,447

[22] Filed: Dec. 10, 1979

[30] Foreign Application Priority Data

Dec. 15, 1978 [AR] Argentina ..... 274837

[51] Int. Cl.[3] ..... A46B 11/00; A46B 13/02; A46B 17/08

[52] U.S. Cl. ..... 401/268; 15/23; 15/24; 15/49 C; 15/50 C; 401/14; 401/193; 401/197; 401/208; 401/282; 401/283; 401/286; 401/289; 401/290

[58] Field of Search ..... 401/5, 14, 15, 193, 401/220, 289, 290, 286–288, 282, 270, 268, 283, 197, 208, 219; 15/24, 103.5, 183, 50 C, 49 C, 23

[56] References Cited

U.S. PATENT DOCUMENTS

| | | | |
|---|---|---|---|
| 691,184 | 1/1902 | Shickler | 401/193 X |
| 1,207,386 | 12/1916 | Ferrer | 15/24 X |
| 1,358,195 | 11/1920 | Gabryszek | 401/289 |
| 1,471,748 | 10/1923 | Miller | 15/24 |
| 2,548,923 | 4/1951 | Walters et al. | 15/24 |
| 2,591,845 | 4/1952 | Magoon | 401/287 |
| 2,730,738 | 1/1956 | Humes | 401/15 X |
| 2,757,406 | 8/1956 | Decker | 15/24 X |
| 4,175,300 | 11/1979 | McGlew et al. | 401/197 X |

FOREIGN PATENT DOCUMENTS

| | | | |
|---|---|---|---|
| 470443 | 9/1914 | France | 401/220 |
| 2302145 | 9/1976 | France | 401/219 |

*Primary Examiner*—Steven A. Bratlie
*Attorney, Agent, or Firm*—Heinrich W. Herzfeld

[57] ABSTRACT

A rotary brush for applying paint to surfaces comprises a housing, a rotatable hollow cylindrical body which bears on the cylindrical surface a plurality of brush units, motor means, passage means for supplying paint from a supply channel to the bristles of the brush units, and a number of stationary guide rings mounted rigidly in the housing and guidingly surrounding the rotatable cylindrical body. The guide rings are disposed in zones transverse to the axis of the cylindrical body and distributed over the length of the same. Each ring bears a slidable bearing means adapted for bearing, for instance with a loose wheel at its free end, against the surface to be painted, thus relieving pressure of the bristles on the surface to be painted.

7 Claims, 7 Drawing Figures

ROTARY BRUSH INCLUDING STATIONARY GUIDE MEANS WITH SLIDABLE BEARING MEANS

SUMMARY OF THE INVENTION

The instant invention refers to a brush specially designed to paint large planar surfaces, in a reduced time and applying paint layers similar to those obtained with conventional manual brushes. The invention consists of a cylinder rotatably around a coaxial hollow shaft, which, through holes provided in all its length, supplies pressurized paint to said cylinder; further including a plurality of removable brushes around said cylinder which are provided with means for passing paint from the cylinder to the brush hairs. This assembly is rotatably mounted in an open housing, having an elongated opening in a longitudinal side, and is connected to a support handle and to a drive means coupled to the cylinder; the assembly further comprising pressurized paint supply channels and power channels for the motor, said motor having command means preferably located in the handle.

PRIOR ART

For painting large surfaces, which generally are planar or similar walls, devices are known which comprise the use of brushes, rollers or sprayers. The paint applied with brushes and rollers is more effective due to the better penetration of such paint, but its application is slow, thus resulting in high labor expenses. On the other hand, the application of paint with sprayers has lower labor costs and is faster, but the penetration is sometimes not enough. Due to the above reasons, the problem of painting large surfaces has not as yet been satisfactorily solved.

ADVANTAGES OF THE INVENTION

The rotary brush of the instant invention permits applying paint with a penetration equivalent to that of the traditional manual brushes and rollers, and as fast as with spraying means. Therefore, this novel brush has all the advantages of the conventional systems: good penetration, rapidity, uniformity and lower labor costs.

NOVELTY OF THE INVENTION

The device of the present invention is based on a new functional arrangement which could be carried out in several different ways. Basically, the invention consists of a hollow body, elongated and rotatable about its axis, which body is rotatably mounted in an elongated housing; on the external surface of the body there are several brush units formed by soft hairs supported in elongated base members which have open channels or grooves in their bottom or inner sides in order to allow the passage of liquid paint from the interior of said hollow body to the interstices between the hairs, the body thus forms a rotor driven by means of a driving unit. Said driving unit is capable of slowly rotating the hollow body and brush units. This driving unit can be an appropriate electric motor, preferably associated to a speed reducer. As an alternative, the driving unit may be a blade turbine driven by compressed air. The hollow body rotates about a coaxial shaft which is also hollow and, on one of its ends is coupled to a duct supplying pressurized paint, while the other end is closed. The paint passes from the hollow shaft to the interior of the holloww body through holes distributed over the entire length of the hollow shaft.

The assembly formed by the hollow body, inner shaft, brushes and driving unit is mounted in a motor casing, said driving unit being located outside the housing, said housing having a large opening in the longitudinal sleeve wall thereof, through which the brush units appear when the hollow body rotates. Besides, such assembly is supported by a tubular handle by means of which the operator holds the assembly. Paint channels and power ducts pass through the mentioned handle. The supply channels are tubes, one for each equipment, which extend from a driving pump associated to a reservoir in a conventional manner, including a check valve preferably located in the hilt of the handle. The ducts providing power to the driving means may be insulated electric leads located also in the interior of the handle, there being a switch on the hilt of the handle. The possibility exists of including a reverse driving device which may be located in the hilt or in the housing. Also compressed air tubes may pass through the handle.

The assembly described above is supplemented by bearing means slidable with respect to the surface to be painted, which may include pressure dampers for controlling brush friction on the surface to be painted. The bearing means are supported by rings mounted stationary in the housing and surrounding the hollow body and also serving as guide means for said hollow body. Said rings may have ball or roller bearings in order to reduce the pressure of the brushes on a surface being painted.

Each of the brush units has a base member with a cavity, channel or groove, open toward the interior of the hollow body in order that the paint deposited in said hollow body may abundantly enter the cavity. Opposite to the cavity in the base member of each brush there is a plurality of holes, and a capillary tube connected to each of them, having a length lower than that of the hairs. These tubes are mixed with said hairs so that the paint, which is pressurized from the cavity, may saturate all hairs of each brush unit. As a convenient accessory, it is advisable to locate a filter in each of the above mentioned cavities, for example a felt extended on the bottom of each cavity.

As optional features, the central shaft may rotate along with the cylinder, or be a fixed element in which case said cylinder will rotate on bearings around the shaft and would be directly coupled to the driving means. Further, the handle of the device may be articulated, thereby providing the vertical displacement of the housing needed in order to apply paint horizontally.

BRIEF DESCRIPTION OF THE DRAWINGS

The above and other advantages of the invention will be apparent for those skilled in the art in the light of the following detailed disclosure taken in conjunction with the attached drawings, which are not intended to limit the scope of the invention but to illustrate an example of same, and in which.

In all figures the same reference numerals refer to equal or equivalent parts or elements constituting the assembly selected as example of the present invention.

DETAILED DESCRIPTION OF THE EXAMPLE

Figure 1:
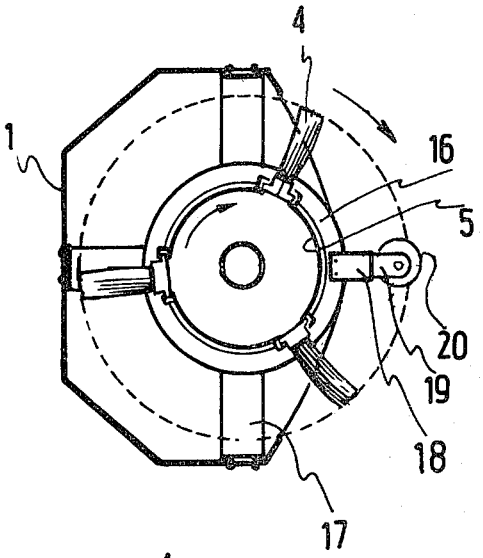
FIG. 1 is a perspective view of a rotary brush according with the present invention.

As may be seen in FIG. 1, the brush of the present invention comprises an elongated housing 1 having in its side wall between its opposite end walls 2, 3 a wide axially extending opening through which the elongated brush units 4 appear, being removably mounted on a cylindric hollow body 5 which is rotatable about a hollow shaft 28 supported by both opposite ends of the housing 1. Said shaft 28, along with the hollow body 5 may be driven by a motor means 6 mounted on the outside of end wall 2 and protected, preferably, by a cover 6*a*. This assembly is attached to a tubular handle 7 which has a hilt 8. In the interior of said handle there is a channel 9 which supplies pressurized liquid paint in order to fill the hollow body 5 and also duct or line 10 supplying power to the motor means 6.

In the hilt 8 there is a command button 11 which actuates a check valve located in the channel 9. The hilt has also a switch 12 turning on or off power flow through duct 10. If the motor means 6 consists of an electric motor-and-speed reducer unit, the duct 10 will be constituted by electric leads, whereas if the mentioned motor means is a compressed air turbine, the duct 10 will be a tube supplying compressed air from a compressor (not shown).

On the other hand, the supply of pressurized paint through channel 9 will be from a conventional pump 13 or from a compressor associated to a reservoir 14, the details of which are not shown. Reference numeral 15 indicates a button or switch used for reversing the action of the motor means 6. If such motor means is an electric motor, the switch 15 will be a reversal switch, and if the motor means is a turbine, the switch 15 will be capable of selectively directing a compressed air inlet conduit in order to match with the different positions of the turbine blades, so that the turbine may rotate in both directions.

The rotary cylindrical body 5 is held in the housing 1 by two surrounding guide rings 16 mounted stationary in two intermediate zones in the housing 1, for instance, by means of cross-pieces 17. Each guide ring 16 carries a bearing assembly comprising a support element 18 and, slidably mounted therein, a bearing arm 19 which bears at its free end a wheel 20 acting as a limiting element to the penetration degree of the brush hairs 4 in the surface to be painted and on which surface said wheels 20 rest.

Figure 5:
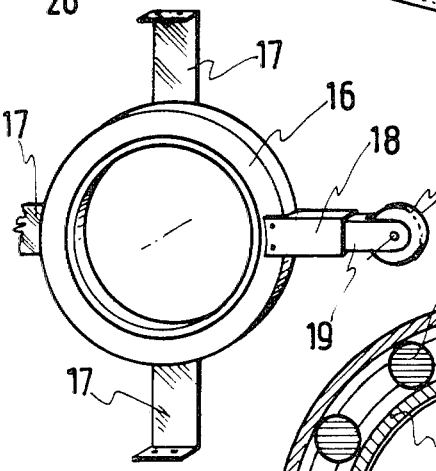
FIG. 5 is a schematic diagram representing one of the means bearing the device on the surface to be painted.
Figure 6:
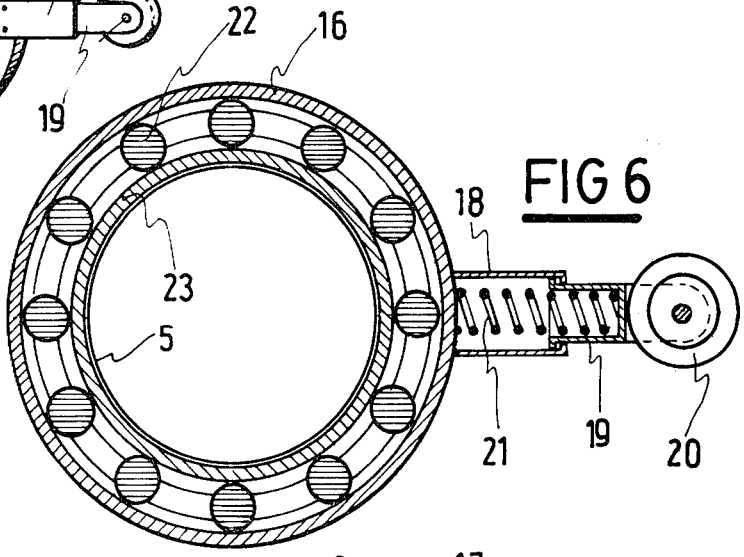
FIG. 6 is a sectional view of the bearing means of FIG. 5.

FIGS. 5 and 6 represent, in more detail, the above mentioned bearing assemblies. It may be seen that the supports 18 include expansion springs 21 capable of damping the pressure exercised on the surface to be painted. As an alternative, rings 16 include ball or roller bearings 22 mounted on an internal race 23 adjusted to the outer surface of the hollow cylindric body 5.

Figure 3:
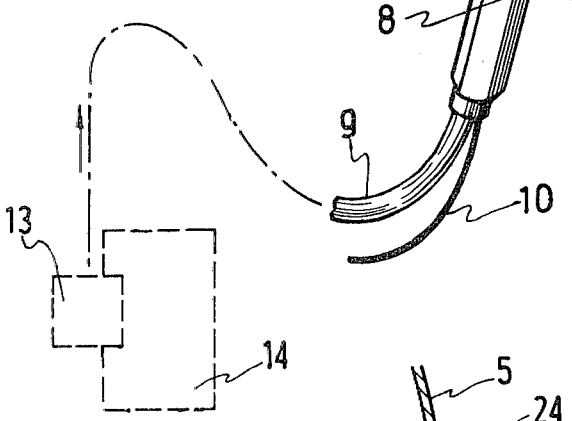
FIG. 3 is a detailed cross sectional view corresponding to one of the brushes of the device of the present invention.
Figure 3:
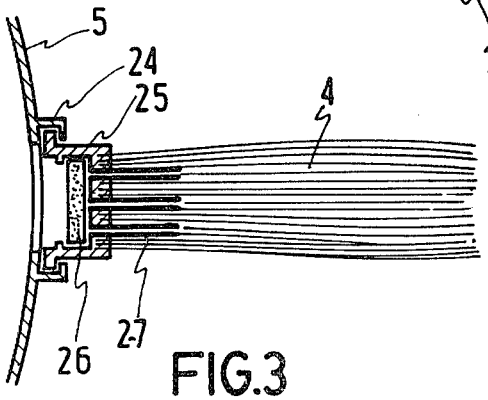
Figure 4:
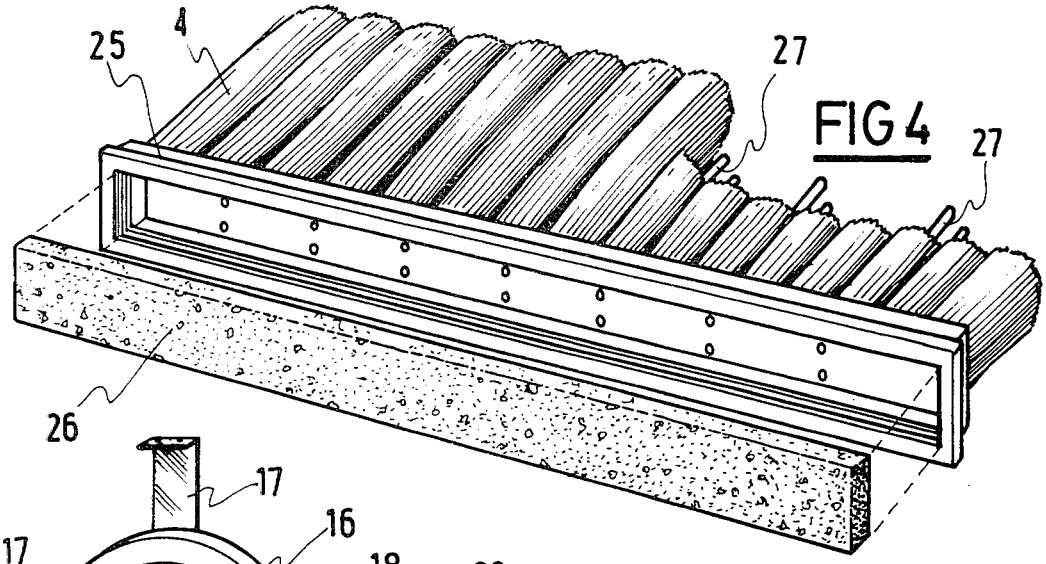
FIG. 4 is a perspective view of a brush, partially disassembled, with a portion of its hair cut out.

Brush units 4 are removably mounted on guide rails 24 provided along generatrixes of the cylindric body 5, as illustrated in FIG. 3. The brush units may extend longitudinally, and the base members 25 of each brush 4 may be inserted in the groove of its guide rail 24. The base member 25 of each brush unit 4 has a cavity on its underside in which cavity a piece of felt 26 can be logded, which piece of felt acts as a filter in front of the entry orifices of capillary tubes 27 which in turn penetrate between the hairs of each brush 4.

Figure 7:
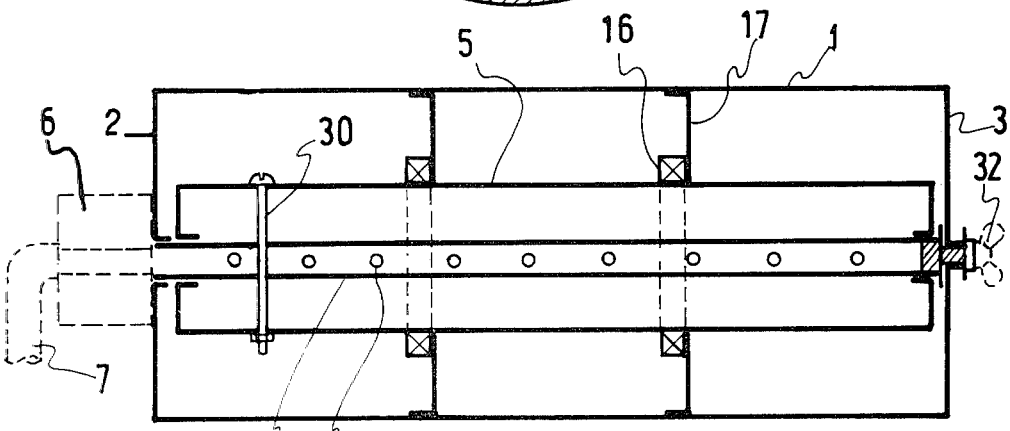
FIG. 7 is a schematic view of a longitudinal section of the device illustrated in FIG. 1, excluding brushes and handle.

In FIG. 7 it may be seen that the rotary cylinder 5 is mounted on a central hollow shaft 28 provided in its cylindrical wall with a plurality of holes or openings 29 which communicate via the hollow interior of shaft 28 with the tubing supplying pressurized paint, which is located in the handle 7. A pin or key 30, or any equivalent means, connects said hollow shaft 28 with the cylinder body 5 so that both may rotate at the same time. As an alternative, without the use of said pin 30, the assembly may have a fixed shaft and a cylinder coupled to the motor.

Figure 2:
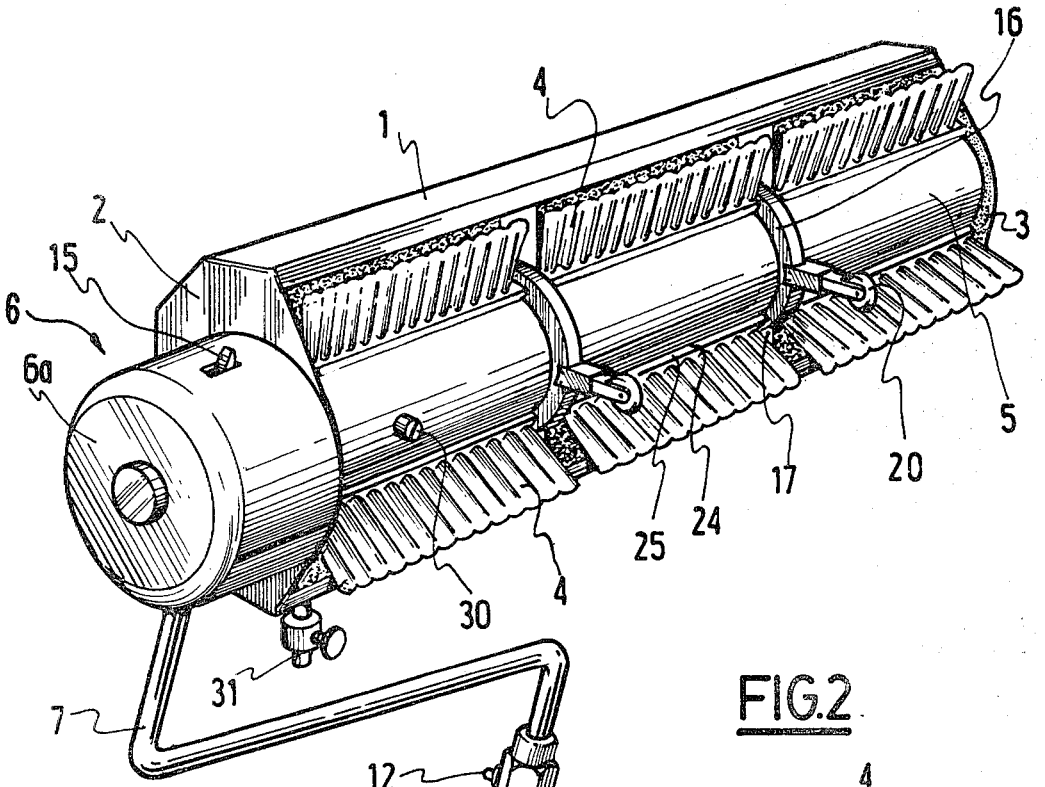
FIG. 2 is a cross section of the brush of FIG. 1.

While in the present embodiment of the invention, in FIGS. 1 and 2, three rows of brush units have been included, there are other embodiments in which the number of rows may be increased or decreased, without any variation in the intended scope of the invention. Further, in FIG. 1 a discharge spout 31 is included in order to remove from the housing paint deposits spilled by the action of the brush units. On the ends of the central shaft 28 and related to end walls 2 and 3 of the housing, bearing means (not shown) could be provided. The mounting of said shaft 28 may be carried out with a known nut 32 in order to facilitate the dismantling of the apparatus.

Additional bearing means making contact with the surface being painted can be rigidly attached, in a manner known per se, e.g., from U.S. Pat. No. 691,184 to Heinrich Schickler, to the opposite end walls of the housing which contains the cylindrical body and brush units.

When building the rotary brush of the present invention, further modifications may be introduced, for example in the motor command means, in the number and distribution of brush units around the cylinder body 5, in the shape of the housing 1, the coupling of the central shaft 28 and the cylindrical body 5 to the motor, inclusion of a screw adjustable articulation for vertical positioning of the housing etc, without going beyond the scope of the present disclosure which is basically determined by the following claims.

What is claimed:

1. A rotary brush comprising:

a housing having two end walls, a longitudinal sleeve wall therebetween, and a large opening in said sleeve wall extending longitudinally between said end walls;

a hollow cylindrical body mounted rotatably in said housing between said end walls thereof and having a cylindrical wall;

a plurality of brush units mounted on the outer surface of said cylindrical wall of said cylindrical body, each of said brush units comprising bristles extending radially with regard to said cylindrical body, and appearing through said large opening in said housing sleeve wall;

motor means mounted on the outer face of one of said end walls and being coupled to said cylindrical body for imparting rotary movement thereto;

paint-supply means connected to the interior of said hollow cylindrical body and adapted for supplying pressurized liquid paint to said interior and to passage means in said cylindrical wall of said cylindrical body, leading from said interior of the latter to between said bristles of said brush units, and being adapted for passing liquid paint on to said bristles;

a number of stationary guide rings rigidly mounted inside said housing in transverse zones arranged in spaced relationship to one another and to said end walls of said housing and guidingly surrounding said cylindrical body; and radially slidable bearing means mounted on said stationary guide rings to project outwardly from said large opening of said housing, said radially slidable bearing means being adapted for bearing against a surface to be painted and limiting contact pressure, at points distributed over the length of said cylindrical body of the bristles of the respective brush units which are in contact with said last-mentioned surface.

2. The rotary brush of claim 1, further comprising a hollow shaft coaxial with and fixedly supporting said cylindrical body for rotation therewith, said hollow shaft being connected to said passage means and being in driving engagement with said motor means, and having a cylindrical shaft wall provided with perforations through which paint can pass from the interior of said hollow shaft to the interior of said hollow cylindrical body.

3. The rotary brush of claim 1, wherein each of said slidable bearing means comprises a retractable arm, resilient means for counteracting retraction of said arm so as to damp the same, and a convex tire wheel mounted freely rotatably on the free end of said arm and adapted for contacting said surface to be painted.

4. The rotary brush of claim 1, wherein each brush unit comprises an elongated bristle-carrying base member having a cavity in the underside thereof facing toward said cylindrical body, and a number of holes in said base member for establishing communication between said cavity and the outer side of said base member carrying said bristles, said holes being part of said passage means.

5. A rotary brush, as claimed in claim 4, wherein a capillary tube, the length of which is less than the length of the bristles, is attached to the bristle bearing outer side of said base member to register with each of said holes.

6. A rotary brush as claimed in claim 4, wherein a filtering element constituted by a band of thick felt is located in the cavity of each base member in front of said holes therein.

7. A rotary brush, as claimed in claim 1, wherein each guide ring comprises rotary bearing means comprising two concentric races between which there is a plurality of balls or rollers.

* * * * *